US008616994B2

(12) United States Patent
Kwon et al.

(10) Patent No.: US 8,616,994 B2
(45) Date of Patent: Dec. 31, 2013

(54) MULTI-FUNCTION GOLF TOOL

(76) Inventors: Yeonwook Kwon, Seoul (KR); Woojoo Kwon, Seoul (KR)

( * ) Notice: Subject to any disclaimer, the term of this patent is extended or adjusted under 35 U.S.C. 154(b) by 160 days.

(21) Appl. No.: 13/211,239

(22) Filed: Aug. 16, 2011

(65) Prior Publication Data

US 2012/0046122 A1 Feb. 23, 2012

Related U.S. Application Data

(60) Provisional application No. 61/436,564, filed on Jan. 26, 2011.

(51) Int. Cl.
*A63B 57/00* (2006.01)

(52) U.S. Cl.
USPC ..... 473/283; 473/286; 473/285

(58) Field of Classification Search
USPC ..... 473/285
See application file for complete search history.

(56) References Cited

U.S. PATENT DOCUMENTS

| | | | | |
|---|---|---|---|---|
| 5,054,777 | A * | 10/1991 | Borden et al. | 473/406 |
| 5,388,824 | A * | 2/1995 | Reimers | 473/406 |
| 6,676,544 | B2 * | 1/2004 | Tyke | 473/406 |
| 7,189,166 | B2 * | 3/2007 | Pare | 473/282 |
| 7,568,294 | B2 * | 8/2009 | Sung | 33/562 |

* cited by examiner

*Primary Examiner* — Michael Dennis
(74) *Attorney, Agent, or Firm* — Morrison & Foerster LLP

(57) ABSTRACT

A multi-purpose golf accessory that incorporates various golfing related functions is disclosed. The golf accessory may comprise a retractable divot fork, a ball marker, a level, a cleaning pad, a nylon brush, a stroke counter, or any combination thereof. The divot fork may be attached to a brush head that comprises one or more brushes, an abrasive brush, an abrasive surface for maintaining golf balls, or any combination thereof. The brush head may be attached within a brush head cover that comprises a counter, tee holders, therapeutic magnets, or any combination thereof. The multi-purpose golf accessory and the brush cover are configured to be attachable to a golfer's belt, other piece of clothing, or a golf bag for convenient carry.

17 Claims, 10 Drawing Sheets

MULTI-FUNCTION GOLF TOOL

RELATED APPLICATIONS

This application is related to Korean patent application no. 2010-0079578, filed on Aug. 18, 2010, and U.S. Provisional Application No. 61/436,564, filed on Jan. 26, 2011, the entirety of which is incorporated by reference herein.

FIELD

The present invention relates to a portable multi-function golf accessory. More particularly, the invention relates to a multi-function portable golf tool for performing two or more of the following functions: maintaining golf greens, cleaning golf balls and clubs, marking golf ball position on a golf green, providing a support for setting down and grasping clubs and other items, and assisting golf aim. Additional golf specific tasks may also be implemented as described in further detail below.

BACKGROUND

Conventionally, it is necessary for a golfer to carry several tools to perform the above mentioned functions. However, carrying multiple tools while playing golf is inconvenient and awkward for the golfer. This inconvenience and additional awkwardness can detrimentally hinder the golfer's swing.

In view of the above mentioned drawbacks and limitations, there is a need for a single golf accessory tool that can perform multiple tasks associated with golfing while being easy to carry so that it will not negatively affect a golfer's game.

SUMMARY

Presently disclosed embodiments are directed to solving issues relating to one or more of the problems presented in the prior art, as well as providing additional features that will become readily apparent by reference to the following detailed description when taken in conjunction with the accompanying drawings.

Embodiments described in the present disclosure relate to multi-function golf tools that comprise several functional elements. For example, one embodiment provides a multi-function golf tool comprising a divot fork configured to be retracted into or extended from a housing in which it resides.

According to another embodiment, a transverse portion of the divot fork extends outwardly through an opening in the main housing. The main housing comprises a longitudinal slot that is parallel with the transverse portion of the divot fork. A bottom portion of a pin is coupled to the divot fork and a top portion of the pin protrudes out from the longitudinal slot in the main housing. In a further embodiment, a knob is physically coupled to the top portion of the pin. In a further embodiment, the knob is coupled to the top portion of the pin. The transverse portion of the divot fork is configured to allow a user to retract and extract the divot fork from the housing by sliding the knob in either direction. The longitudinal slot is configured to guide the pin of the transverse portion of the divot fork as it slides to provide smooth retraction and extraction of the divot fork into and out of the main housing. In a further embodiment, the knob is magnetic and a magnetic ball marker is magnetically coupled to the knob.

In a further embodiment, the multi-function golf tool may further comprise a golf ball cleaner coupled to a bottom surface of the housing. In a further embodiment, the bottom surface and the golf ball cleaner are configured in a concave shape so as to conform to the round shape of a golf ball for easier cleaning.

In a further embodiment, a semi-circular ball liner is attached to the housing via a hinge that allows the ball liner to swing toward or away from a main housing of multi-functional golf tool. The hinge further provides a clamping force between the main housing and the ball liner. This configuration allows a golfer to hang the multi-purpose golf tool on their belt using the clamping force of the semi-circular ball liner. Additionally, the ball liner is configured to prop up or clamp onto clubs, cigars, and cigarettes when the divot fork is stuck into the ground. In a further embodiment, the semi-circular ball liner comprises a longitudinal cut that allows a user to draw a targeting line on a golf ball.

In a further embodiment, a level is attached to a top surface of the housing. The level is configured to measure the gradient of the golf green to assist a golfer in aiming a golf ball. In a further embodiment, a multi-function golf tool comprises a stroke counter to accurately keep track of the number of strokes the golfer has taken during play.

In one embodiment, a brush head may be removably coupled to an exposed divot fork. The brush head comprises a cavity configured to receive at least a portion of the divot fork therein and mechanically or magnetically hold the divot fork in a secure but releasable fashion. In a further embodiment, the brush-head comprises a brush, an abrasive sponge, and a torn ball finisher.

In a further embodiment, the brush head may contained within a brush cover. The brush cover may comprise an opening and a door. The opening is configured to accommodate a portion of the multi-purpose golf tool and the door closes the brush cover to affix the multi-purpose golf tool within. According to a further embodiment, the brush cover door may be closed by utilizing a spring plate. According to a further embodiment, the door and the brush cover may contain one or more magnets to magnetically affix the brush cover in a closed position. According to a further embodiment, the brush cover may comprise a tee holder, a stroke counter, a hanger, or one or more therapeutic magnets.

In one embodiment, a divot fork may be coupled to a first end of a semi-circular ball liner. The second end of the semi-circular ball liner may be couple to a main housing. The semi-circular ball liner may have a longitudinal cut to enable a golfer to aim balls and to mark balls with aiming lines. In a further embodiment, the multi-purpose golf tool may further comprise a level, a ball marker, a stroke counter, a cleaning pad, or any combination thereof.

BRIEF DESCRIPTION OF THE DRAWINGS

FIG. 2(*b*) shows a top view of the multi-function golf tool of FIG. 1.

FIG. 5(*b*) shows a cross sectional bottom view of the multi-function golf tool of FIG. 1.

FIG. 7(*b*) shows a rear view of the golf tool of FIG. 6.

FIG. 13(*b*) shows how a multi-function golf tool of FIG. 1 can be used to assist in aiming a golf ball.

FIG. 14(*b*) shows a cross-sectional side view of the brush head of FIG. 14(*a*).

FIG. 17(*b*) shows a perspective view of the assembly of FIG. 17(*a*) as the multi-function golf tool and the brush head are being removed from the brush head cover, in accordance with one embodiment of the invention.

DETAILED DESCRIPTION OF EXEMPLARY EMBODIMENTS

In the following description of exemplary embodiments, reference is made to the accompanying drawings which form a part hereof, wherein like elements are referenced with like numerals throughout. It is to be understood that other embodiments can be used and structural changes can be made without departing from the scope of the invention.

Figure 1:
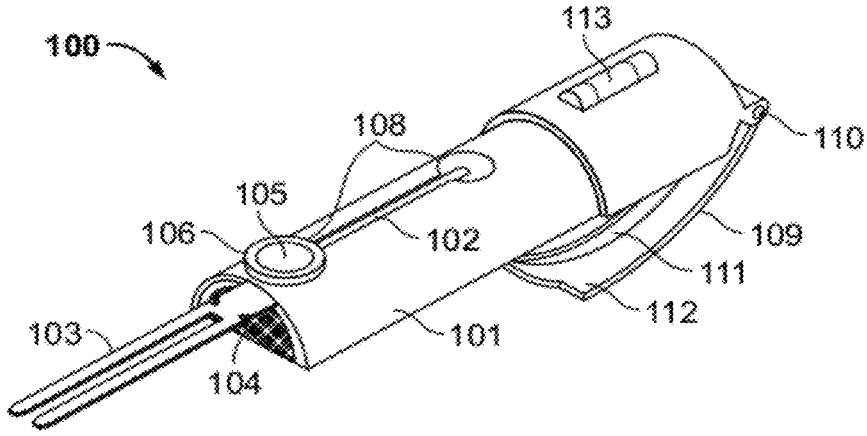
FIG. 1 shows a perspective view of a multi-function golf tool, in accordance with one embodiment of the invention.

FIG. 1 is a perspective view of an exemplary multi-function golf tool 100. The multi-function golf tool 100 comprises a main housing 101, a front surface that has an opening, a rear surface, a top surface that has a longitudinal slot 102, and a bottom concave surface. The multi-function golf tool 100 further comprises a divot fork 103 that is configured to reside within the main housing 101, and which may be extracted from the housing 101 through the opening on the front surface. The base of the divot fork 103 has flanged shoulders 104 at its base which serve to latch the divot fork 103 to a brush head, as described in further detail below.

Figure 6:
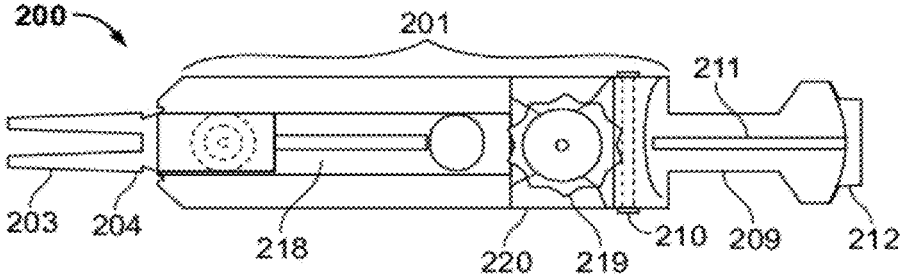
FIG. 6 shows a cross-sectional view of a multi-function golf tool that comprises a stroke counter, in accordance with one embodiment of the invention.

In another exemplary embodiment, the divot fork 103 may lack flanged shoulders 104 and may contain other methods of attachment to a brush head (see FIG. 6, element 600). For example, the divot fork 103 may comprise one or more depressions and the brush head may comprises one or more corresponding protrusions to removably latch the divot fork 103 in the brush head body. It is further envisioned that the brush head may act as a latch to enable it to removably latch the divot fork 103. It is further envisioned that the divot fork 103 and its corresponding entry point in the brush head may be shaped in any manner so that the divot fork 103 may be removably latched to the brush head through known mechanical latching techniques.

A detachable ball marker 105 configured to mark a golf ball position on a putting green is magnetically affixed to a knob 106 that is coupled to the divot fork 103 through a pin 107 (see FIG. 3) that extends upwardly from a surface of the divot fork 103 through the longitudinal slot 102. According to exemplary embodiments, the pin 107 may be magnetically or physically coupled to the knob 106. A user can extend or retract the divot fork 103 from the main housing 101 by sliding the ball marker 105 and knob 106 along the longitudinal slot 102 towards the front or rear surface of the main housing 101. The divot fork 103 can be placed in an extended or retracted position when the knob 106 is placed in depressions 108 provided at both ends of the longitudinal slot 102 on the main housing 101. In one exemplary embodiment, magnets (not shown) are located near the depressions 108 to provide magnetic latching of the divot fork 103 in its extended and retracted positions. An extended divot fork 103 can be used to repair divots on the golf green and to clean grooves on the head of golf clubs. When not in use, the divot fork 103 may be retracted into the main housing 101 for safe stowing. It is envisioned that embodiments of the current invention may utilize a spring plate and no depressions 108 or a spring plate and depressions 108 and still be within the scope of the invention.

In one exemplary embodiment, the knob 106 is constructed of a neodymium super magnet (NdFeB) or may at least comprise such a magnet in its construction. The neodymium super magnet is made of an alloy of neodymium, iron, and boron. The application of the neodymium super magnet can provide a magnetic attraction between the knob 106 and the divot fork 103 and between the knob 106 and the ball marker 105. The ball marker 105 is removable from a top surface of the knob 106 to mark golf ball locations on putting greens.

The multi-function golf tool 100 further provides a ball liner 109 attached to the rear surface of the main housing 101 through a hinge 110. The hinge 110 may be configured or made according to various known techniques and, in one embodiment, may be spring-loaded or biased against opening or hinging away from the may housing 101. In one exemplary embodiment, an elastic force may bias the hinge 110 against opening. As shown in FIG. 1, the ball liner 109 is shaped to be semi circular in order to accommodate the shape and size of a golf ball. The ball liner 109 provides a longitudinal cut 111 that may be used to mark golf balls with a targeting line using a pen or marker. The ball liner 109 can also used to hang the multi-function golf tool 100 on a golfer's belt with the assistance of a belt groove 112 located at the end of ball liner 109. The belt groove 112 can help secure the ball liner 109 and the multi-function golf tool 100 onto a player's belt when the ball liner 109 is folded inward towards the main housing 101. Exemplary embodiments of the ball liner 109 provide a clamping force so that the multi-function golf tool 100 may be securely clamped onto a golfer's belt.

Exemplary embodiments of the multi-function golf tool 100 may further comprise a level 113 placed on the top surface of the main housing 101 in order to measure a gradient of a golf green surface. In one embodiment, the level 113 is tubular with a length of approximately 30 millimeters which could, if used by itself, be inaccurate due to a smaller contact surface with the green. The level 113 used in conjunction with the multi-function golf tool 100, however, has a longer contact surface (e.g., 80 millimeters) with the green which improves the accuracy of the level 113.

It is envisioned that the level may 113 be used for training or other purposes and that embodiments of multi-function golf tool 100 may not include a level 113. Further, it is envisioned that a multi-function golf 100 tool may comprise any of the above mentioned features, alone or in combination, and be within the scope of this invention. Embodiments of the invention may exclude or include any number of features according to specific tools described herein. Further, the multi-function golf tool as illustrated in exemplary embodiments of the invention may be compact for easy stowing and carrying on a golfer's belt, bag, pockets, or on a brush case (see FIG. 14).

Figure 2A:
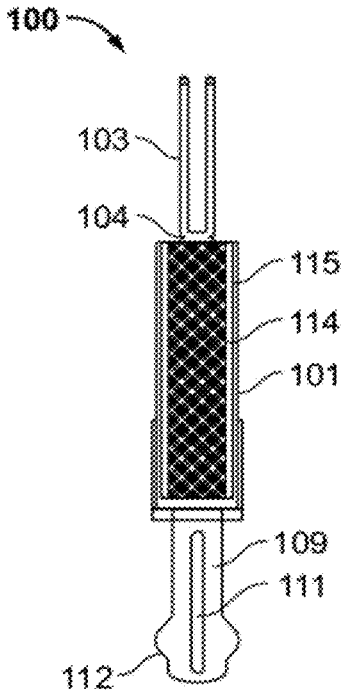
FIG. 2(*a*) shows a bottom view of the multi-function golf tool of FIG. 1.
Figure 2B:
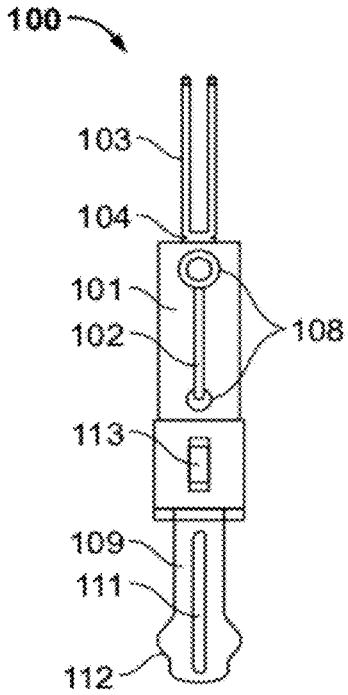

Exemplary embodiments of the multi-function golf tool comprise a cleaning pad 114 made of microfiber attached to Velcro tape 115 via a plurality of Velcro hooks (not shown) and a plurality of Velcro loops (not shown) as illustrated in FIGS. 2(*a*) and (*b*). In one exemplary embodiment, the Velcro hooks are attached to the bottom concave surface of the main housing 101 and the Velcro loops are attached to a back surface of the cleaning pad 114. In this manner, the cleaning pad 114 may be removed and attached to the Velcro tape 115. The cleaning pad 114 may be used to provide sufficient cleaning in a compact multi-function golf tool 100 so that a bigger towel will no longer be needed to clean golf balls on a golf course.

A golfer can hang the multi-function golf tool 100 on his or her belt with the ball liner 109 and extend the main housing 101 upwards to expose the cleaning pad 114. The golfer can then rub a golf ball on the cleaning pad 114 to remove dirt and other foreign substances. In this manner, the golfer can clean the golf ball without removing the multi-function golf tool 100 from his or her belt. Additionally, the cleaning pad 114 may be used to brush soil, sand particles, and other debris off the ball onto the golf course. To allow more effective cleaning, exemplary embodiments provide a concave underside of the main housing 101 to allow for greater contact pressure between the cleaning pad 114 and the golf ball. The cleaning pad 114 may be removed from the main housing 101 for cleaning after a round of golf or whenever cleaning is desired.

Figure 3:
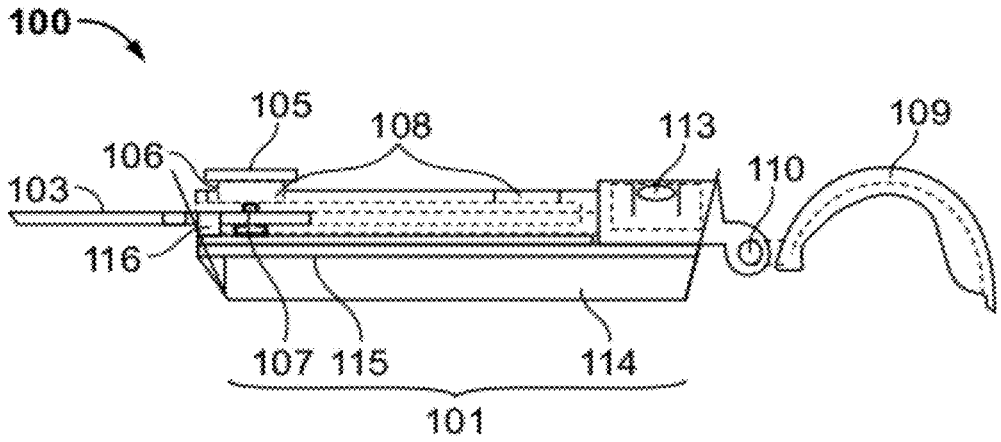
FIG. 3 shows a cross sectional side view of the golf tool of FIG. 1.

According to an exemplary embodiment illustrated in FIG. 3, a bottom portion of a pin 107 may be attached to a top surface of a divot fork 103. The top portion of the pin 107 protrudes out of a longitudinal slot 102. The longitudinal slot 102 is configured to allow the knob to slide the divot fork 103 in and out of the main housing 101. According to an exemplary embodiment, the top portion of the pin 107 may be magnetically coupled to the knob 106 while the other end of the pin 107 may be physically coupled to the divot fork 103. According to a further embodiment, the top portion of the pin 107 may be physically couple to the knob 106. It is envisioned that the divot fork 103 may be attached to the knob 106 in any manner known in the art.

Figure 4:
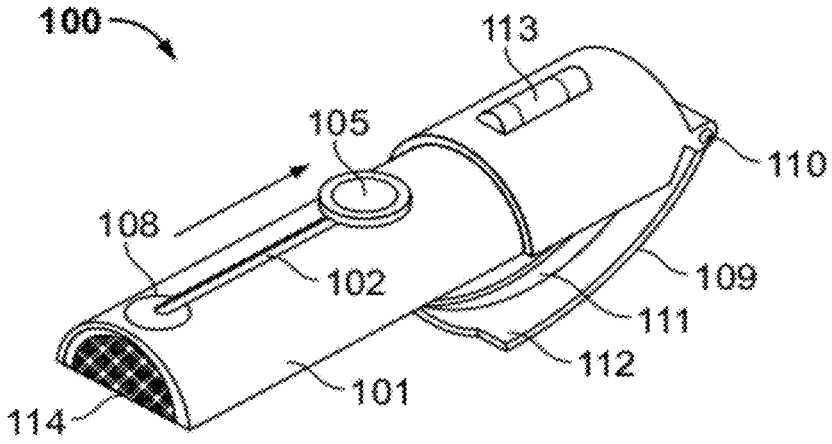
FIG. 4 shows a perspective view of the multi-function golf tool of FIG. 1 when the divot fork is retracted within the main housing of the tool.

A golfer can hold the divot fork 103 in an extended position by moving the ball marker 105 attached to the knob 106 into the depression 108 near the front surface of the main housing 101. The magnetic force between the knob 106 and the divot fork 103 places the knob 106 into the depression 108. A golfer may move the knob 106 out of the front depression 108 to retract the divot fork 103. FIG. 4 shows a perspective view of a multi-function golf tool 100 of FIG. 1 when the divot fork 103 is retracted within the housing of the tool 100 and the marker 105 and knob 106 are positioned within the rear depression or latch position 108.

It is further envisioned that the main housing 101 may comprise a spring plate that latches either the knob 106 or the divot fork 103 when the divot fork 103 is in a retracted or extracted position. A spring plate may be used in lieu of, or in addition to, the depressions 108. It is further envisioned that the main housing 101 may comprise a plurality of internal latches that enable the divot fork 103 to be fully or partially extracted or retracted (e.g., similar to a portable razor or box cutter). It is further envisioned that the divot fork 103 may be latched within the housing in an extracted or retracted position through known mechanical latching techniques.

The multi-function golf tool 100 further provides a divot fork filter 116 that can be made of cotton fabric, sponges, or brush bristles which are attached to the opening of the front surface of the main housing 101 in order to make contact with the divot fork 103. This contact allows the divot filter 116 to remove soil and other materials from the divot fork 103 as it moves in and out of the main housing 101. Thus, the divot fork 103 remains clean throughout use.

Figure 5A:
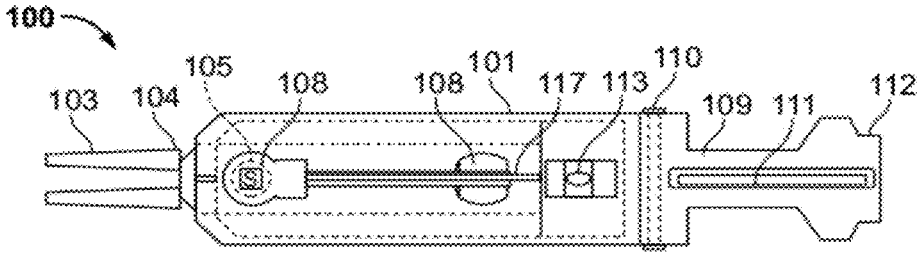
FIG. 5(*a*) shows a cross sectional top view of the multi-function golf tool of FIG. 1.
Figure 5B:
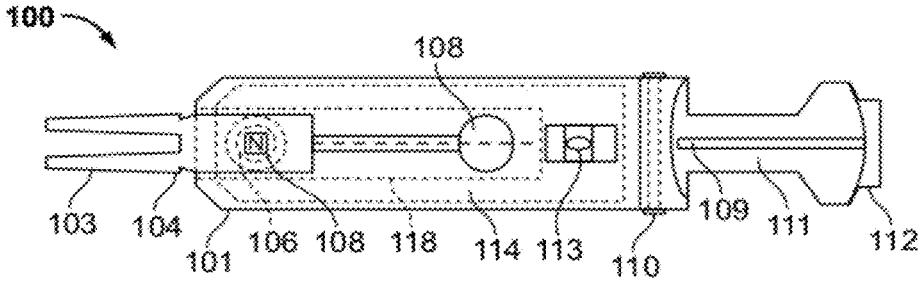

FIG. 5(*a*) illustrates an exemplary embodiment of the multi-function golf tool 100 comprising a travel path 117 of the divot fork 103 as it moves between extracted and retracted positions. In one embodiment, the travel path 117 is facilitated by a longitudinal groove located within the housing 101 that is co-linear and parallel with the longitudinal slot 102 provided on the top surface of the main housing 101. A bottom portion of the pin 107, discussed above, is configured to move or slide within the longitudinal groove. According to exemplary embodiments, the divot fork chamber 118 may reside within the main housing 101 as illustrated in FIG. 5(*b*). The divot fork chamber 118 is configured to enclose the divot fork 103 in its retracted state. The divot fork chamber 118 is further configured to guide the divot fork 103 during extraction and retraction to provide smooth and/or stable linear motion.

FIG. 6 shows a cross sectional top view of an exemplary multi-function golf tool 200 that comprises a stroke counter 219 configured to allow a golfer to track strokes during play. The multi-function golf tool 200 further comprises a divot fork 203, ball marker 205 magnetically coupled to a knob 206 attached to the divot fork 203, a ball liner 209, a ball cleaning pad 214 and divot fork filter 216, which are similar to the corresponding items discussed above with respect to FIGS. 1-5. However, it should be understood that the features and functions provided and cross-referenced are exemplary.

Figure 7A:
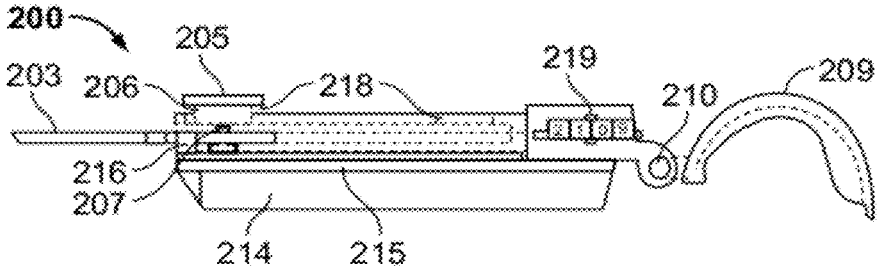
FIG. 7(*a*) shows a cross-sectional side view of a multifunction golf tool of FIG. 6.
Figure 7B:
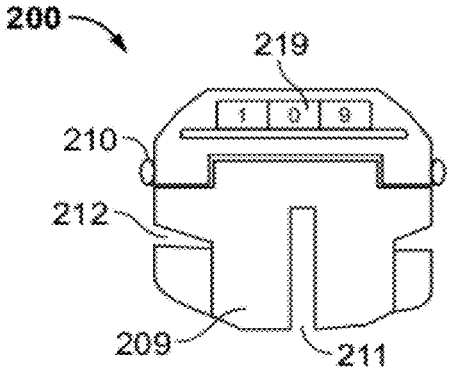

A stroke counter 219 is affixed within the main housing 201 of the multi-function golf tool 200. According to an exemplary embodiment, the stroke counter 219 can count a range of numbers (e.g., from one to ten) and a golfer can use their finger to change the stroke count number on the stroke counter 219 by rotating the counter 219 either clockwise or counter-clockwise. According to an exemplary embodiment, the numerical value of the stroke counter may be visible to the golfer as illustrated in FIGS. 7(*a*) and 7(*b*). According to exemplary embodiments, a golfer can change the stroke count on the stroke counter 219 and view the stroke count when the multi-function golf tool 200 is hung on the golfer's belt, article of clothing, or golf bag.

Figure 8:
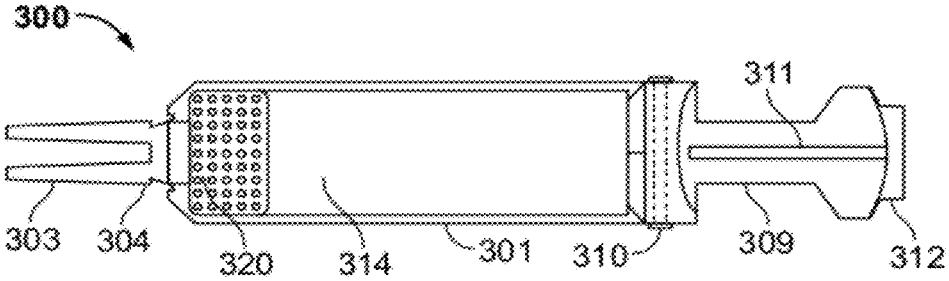
FIG. 8 shows a bottom view of a multi-function golf tool that shows a wet sand brush, in accordance with one embodiment of the invention.
Figure 9:
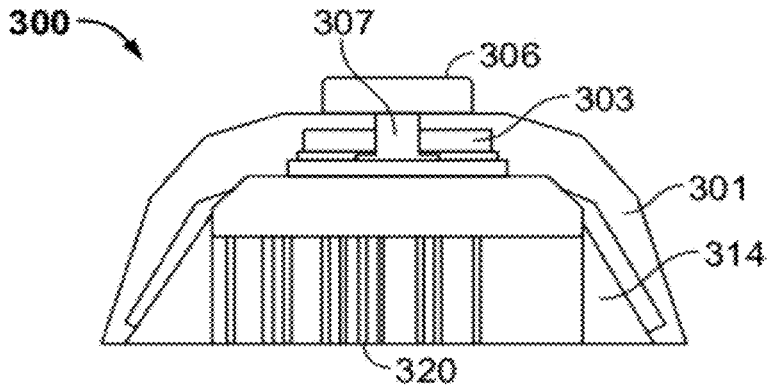
FIG. 9 shows a cross sectional front view of the multi-function golf tool of FIG. 8.

FIG. 8 illustrates a bottom view of an exemplary multi-function golf tool 300 which comprises a divot fork 303, a ball liner 309, a golf ball cleaning pad 314 and a wet sand brush 320 affixed to a bottom surface of the main housing 301. According to an exemplary embodiment, the cleaning pad 314 is made from a suitable cloth or fabric material that is washable and replaceable such as microfiber. The wet sand brush 320 can be used to remove wet sand or other debris that may have accumulated on the golf ball during play. Thereafter, the ball can be cleaned using the cleaning pad 314. During play, when the multi-function golf tool 300 is hung on a player's belt, article of clothing, or golf bag via the ball liner 309 and belt groove 312, the player may swing the main housing portion 301 upward via hinge 310 so that the cleaning pad 314 is exposed to clean a golf ball easily and conveniently. An exemplary wet sand brush 320, retractable divot fork 303 located above a brush 320, wherein a pin 307 and a knob 306 coupled to the divot fork 303 are illustrated in the exemplary cross-sectional side view of FIG. 9.

Figure 10:
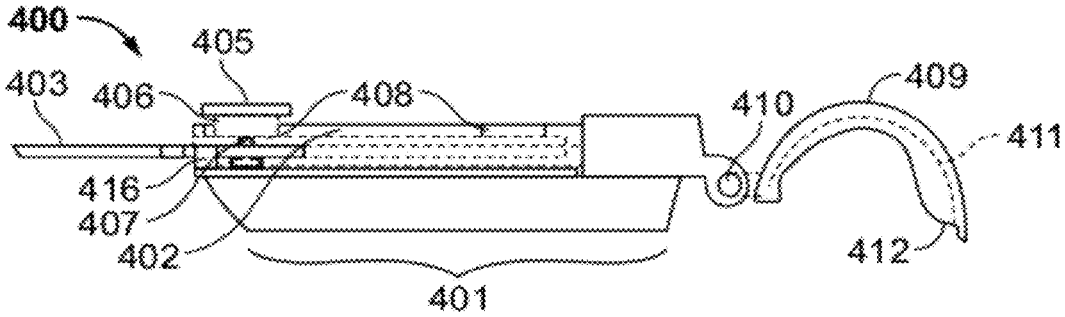
FIG. 10 shows a cross-sectional side view of a multi-function golf tool, in accordance with one embodiment of the invention.

The embodiments disclosed herein are exemplary. It is envisioned that embodiments may comprise or lack several functions described herein. For example, FIG. 10 depicts a multi-function golf tool 400 that contains many elements similar to the elements shown in FIGS. 1-9 but does not include a leveler, stroke counter, brush or ball cleaning pad.

Figure 11:
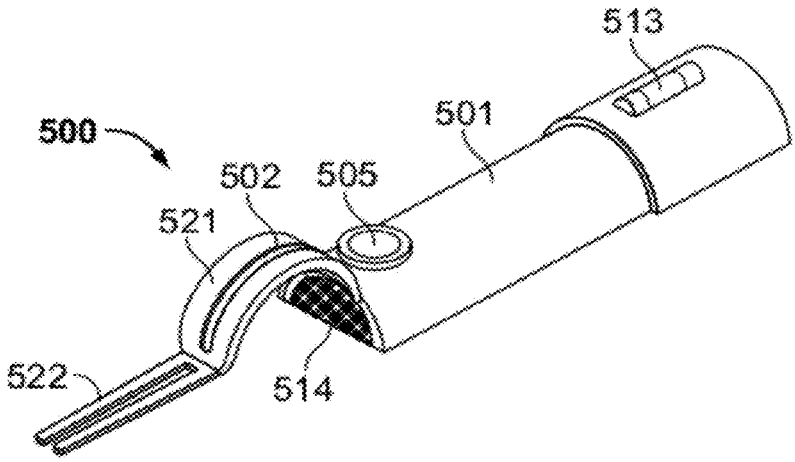
FIG. 11 shows a perspective view of a multi-function golf tool, in accordance with another embodiment of the invention.

According to an exemplary embodiment depicted in FIG. 11, a divot fork 522 may be integrally attached to a ball liner 521 that has a semi-circular shape. The ball liner 521 is attached to the front surface of the main housing 501 wherein the ball liner 521 has a longitudinal cut 502. In one exemplary embodiment, the divot fork 522 and the ball liner 521 can be hinged to the front surface of the main housing 501 so that they may swing into open and closed configurations with respect to the main housing 501.

Figure 12:
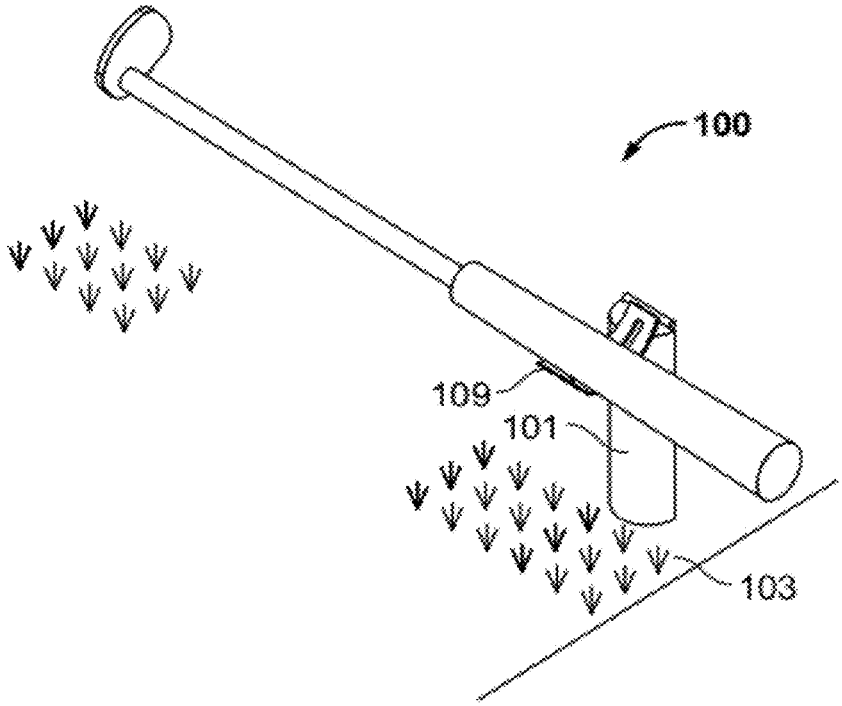
FIG. 12 shows how a multi-function golf tool of FIG. 1 can hold a golf club off the ground.

FIG. 12 illustrates an exemplary embodiment where the retracted divot fork 103 of the multi-function golf tool 100 of FIG. 1 is stuck into the ground to affix the multi-function golf tool 100 in an upright position. The ball liner 109 may be opened so that it may hold a golf club off the ground. Propping up the golf club prevents the handle of the golf club from touching moisture or debris on the ground thereby preventing golf club handles from getting wet or dirty. Dry and clean golf grips allow a golfer to swing the golf club more effectively. Additionally, the multi-function golf tool 100 can hold other items (e.g., a cigar, cigarette) by propping them up to prevent contact with the ground. Additionally, it is envisioned that the ball liner 109 may be used to clamp onto the above mentioned objects when there is high wind or any other appropriate scenario.

Figure 13A:
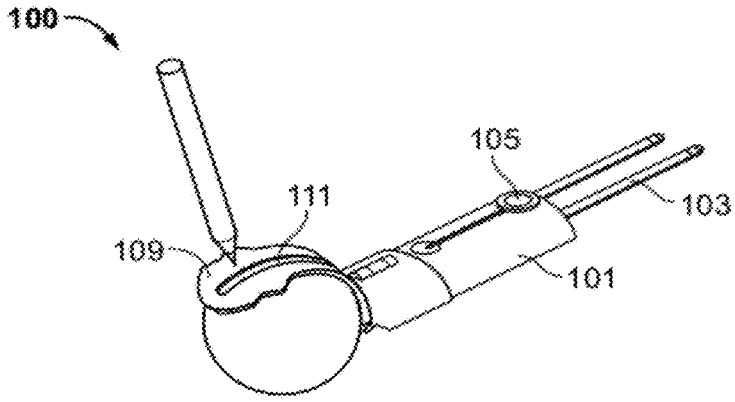
FIG. 13(*a*) shows how a multi-function golf tool of FIG. 1 can be used to draw a target line on a golf ball.
Figure 13B:
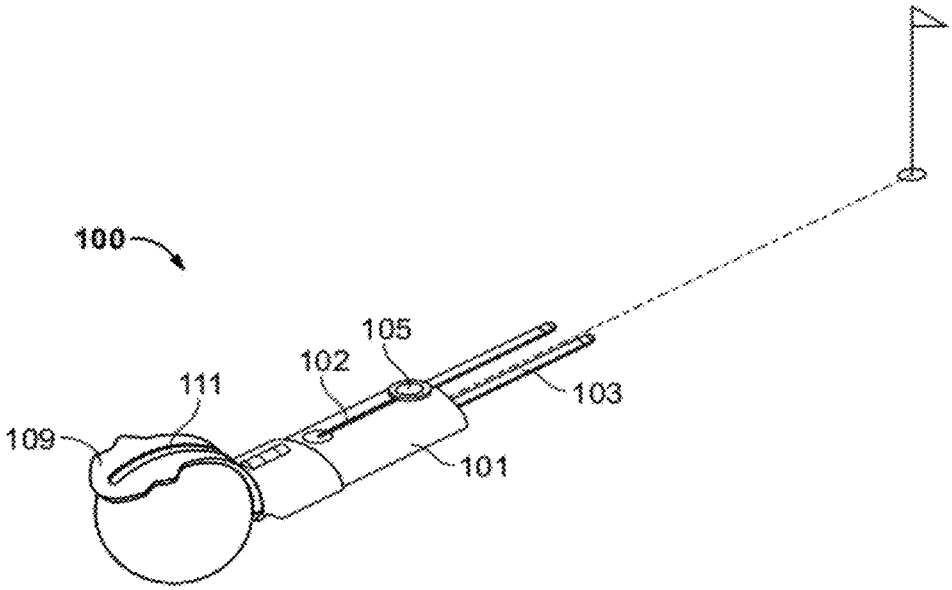

The multi-function golf tool 100 of FIG. 1 can be used to draw a line on a golf ball as illustrated in FIG. 13. First, a golf ball is placed into the semi-circular concave portion of the ball liner 109. Next, a writing instrument is used to draw a straight line through the longitudinal cut 111 onto the golf ball. This straight line can then be used to aim the golf ball before putting as is illustrated in the exemplary embodiment of FIG. 13(*b*). According to an exemplary embodiment, aim is provided through the golf ball's marked line, the longitudinal cut 111 of the ball liner 109, the longitudinal slot 102, and the divot fork 103. The longer line provided by the above features allows a golfer to aim more efficiently. Alternatively, in a further embodiment, a golfer may use only the targeting line drawn on the golf ball to help aim the golf ball on a putting green.

Figure 14A:
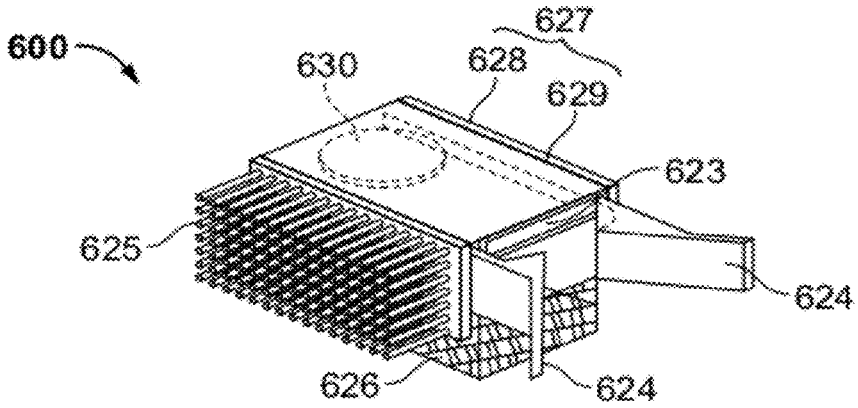
FIG. 14(*a*) shows a perspective view of a brush head that can be used to clean a golf club or other golf item, in accordance with one embodiment of the invention.
Figure 14B:
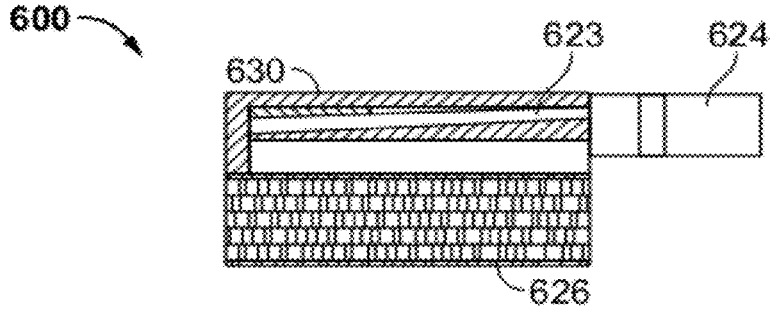

An exemplary embodiment of a brush head 600 configured to clean golf clubs and golf balls is illustrated in FIG. 14(*a*). An insertion point 623 is located on one end of the brush head 600 to allow insertion of a divot fork 103. A multi-function golf tool 100 that has the divot fork 103 inserted to the insertion point 623 of the brush unit 600 may be worn on a belt of a user. In one embodiment, the insertion point 623 is sloped at a pre-determined angle (e.g., 10 degrees). Because the insertion point 623 of the brush head 600 is sloped outwards, the multi-function golf tool 100 will also slope outwards and provide space between the multi-function golf tool 100 and the golfer's hip. The brush head 600 contains protruding latches 624 that can be made of the same plastic material as that of the brush head 600 and can temporarily deform to allow the golfer to latch and remove the divot fork 103 through engagement of the flanged shoulders 104 with the latches 624.

It is further envisioned that the divot fork 103 and its corresponding insertion point 623 located within the brush head 600 may be shaped in any manner to enable the divot fork 103 to be removably latched to the brush head 600. It is envisioned that the protruding latches 624 may be horizontally arranged as illustrated in FIGS. 14(*a*) and (*b*) or vertically arranged. It is further envisioned that the protruding latches 624 may be shaped in any manner known in the art to enable them to removably latch the divot fork 103 within the brush head 600. It is further envisioned that the divot fork 103 may comprise one or more depressions or protrusions and the insertion point 623 may comprises one or more corresponding protrusions or depressions to removably lock the divot fork 103 in the brush head body. It is further envisioned that the divot fork 103 and the insertion point 623 may be shaped in any manner so that the divot fork 103 may be removably latched to the brush head through known mechanical latching techniques.

In one exemplary embodiment, the brush head 600 comprises a nylon brush 625 and an abrasive brush 626 wherein both brushes are configured to remove soil and other debris from golf clubs. The abrasive brush 626 is adjacent to the brush 625 on an alternate surface of the brush head 600. In a further exemplary embodiment, the abrasive brush 626 is made of an abrasive sponge material with a nylon filament that is coated with fine, abrasive grains for removing debris and dirt from golf club heads. The abrasive grains in the abrasive brush 626 may be contained in the nylon filament or attached by spraying a mixture of abrasive grains on the nylon filament and then heating both the filament and the abrasive grains. According to exemplary embodiments, the abrasive brush or cleaner 626 may be made from any suitable abrasive material such as sand paper/cloth or steel wool, for example, and other similar materials known in the art. Exemplary embodiments of the abrasive brush 626 may comprise fine abrasive materials that are more efficient for cleaning and are safer than wire brushes. In further exemplary embodiments, the fibers of the abrasive brush 626 may be of non-woven fibers to enable the abrasive brush 626 to effectively clean the grooves of golf club heads.

Exemplary embodiments may comprise a ball maintenance kit 627 that is located on the surface of the brush head 600 opposite the nylon brush. The ball maintenance kit 627 may be composed of sandpaper 628 that is attachable to the brush head 600 surface via Velcro tape 629 or other adhesives known in the art. The ball maintenance kit 627 may be used to repair balls that have been torn. In exemplary embodiments, the sandpaper 628 of the maintenance kit 627 may be a metal file or any other suitable material known in the art. The brush head 600 further contains a brush-head magnet 630 that may be used to attach the brush head 600 to a brush head cover 700 (see FIG. 15).

Figure 15:
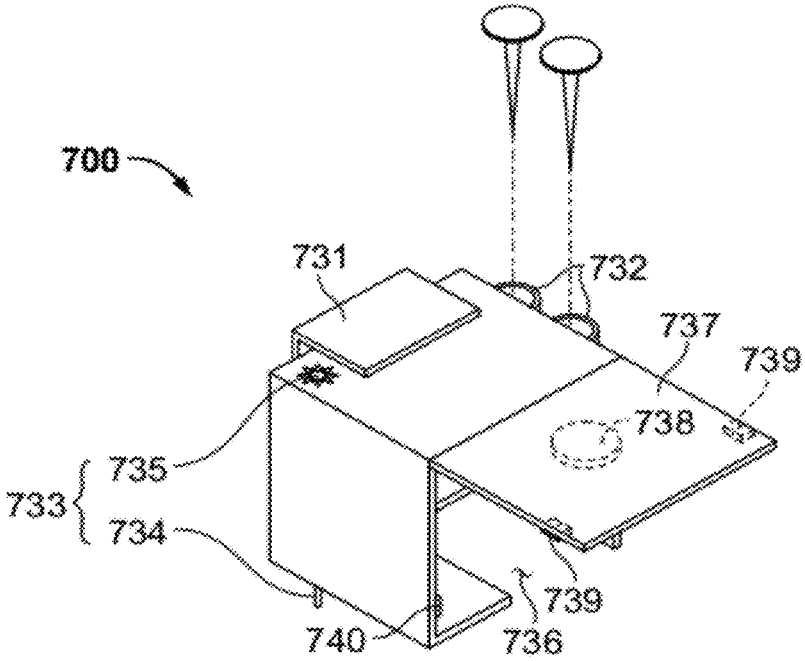
FIG. 15 shows a perspective view of a cover for the brush head of FIGS. 14(*a*) and 14(*b*), in accordance with one embodiment of the invention.

An exemplary cube-shaped, brush cover 700 which provides a hanging hook 731 that allows a golfer to hang the brush cover 700 on their belt is illustrated in FIG. 15. The cover 700 comprises one or more golf tee holders 732 that are configured to holds golf tees. In one embodiment, the hanging hook 731 can contain a therapeutic magnet (not shown) which is believed by many to promote health. The brush cover 700 further provides a swing counter 733 which comprises an input push button 734 and a swing count viewer 735. By pressing the push button 734, a player can increment the swing count viewer 735 by one. This counting functionality allows a golfer to keep track of the number of strokes he or she has taken during play. In one embodiment, the swing counter 733 is an electronic counter.

The brush cover 700 has an opening 736 to accommodate the main body 101 of the multi-function golf tool 100 when the brush head 600 is placed within the cover 700 and a door 737 of the brush cover 700 is closed. In one embodiment, the door 737 contains a door magnet 738 which has an opposite polarity to that of the brush-head magnet 630. When the brush head 600 is inserted into the brush cover 700, the brush-head magnet 630 magnetically couples to the door magnet 738 to affix the brush head 600 to the brush cover 700. Thereafter, the door 737 can be closed to allow a divot fork 103 to be inserted into the insertion point 623 of the brush head 600. In a further embodiment, the cover 700 comprises magnets 739 within the door and corresponding magnets 740 on side walls configured to couple with the magnets 739 when the door 737 is in a closed state. The magnetic attraction between the magnets 739 and 740 keep the door 737 closed. Further, the door magnet 738 can magnetically couple to the knob 106 or a ball marker 105 of the multi-function golf tool 100 to assist in further securing the tool 100 to the brush head 600 and cover 700. It is further envisioned that embodiments of the brush cover 700 may comprise magnets that may be used to attract and stow other objects.

According to another exemplary embodiment, the cover 700 may comprise a spring plate in addition to, or in lieu of, the magnets 739 and their corresponding side wall magnets 740. The spring plate can provide a physical force that closes the door 737. It is further envisioned that any other method of door closure or hingable attachment known within the art may be used to close the door 737 of the brush cover 700 and still be within the scope of the invention.

Figure 16:
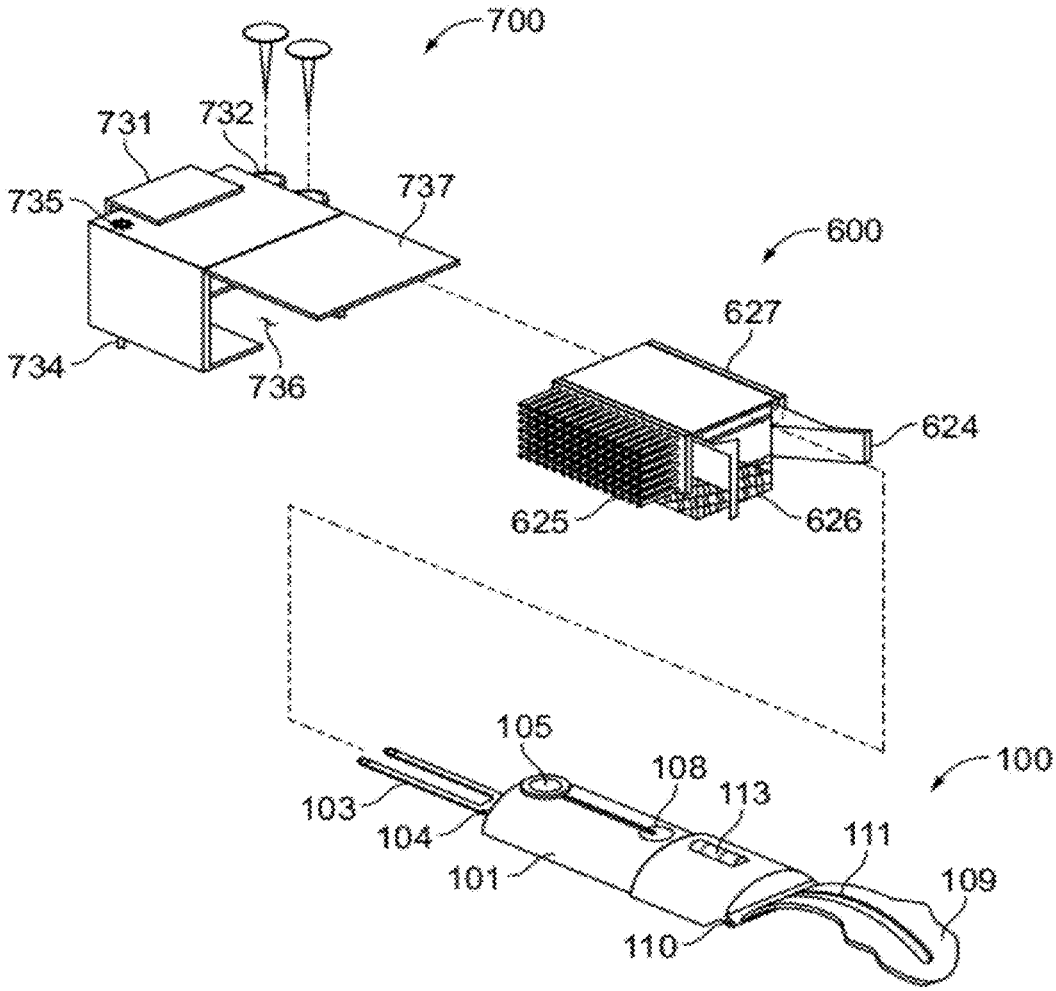
FIG. 16 shows a view of a multi-function golf tool, a brush head and a brush head cover before they are coupled together, in accordance with one embodiment of the invention.

A multi-function golf tool 100, a brush head 600 and a brush head cover 700 may be coupled together as illustrated in the exemplary embodiment of FIG. 16. The latches 624 mechanically couple with the flanged shoulders 104 of the divot fork 103 when the divot fork 103 is inserted into the insertion point 623 of the brush head 600. The brush head 600 can be inserted into the brush cover 700 and the door 737 can then be closed as disclosed above.

Figure 17A:
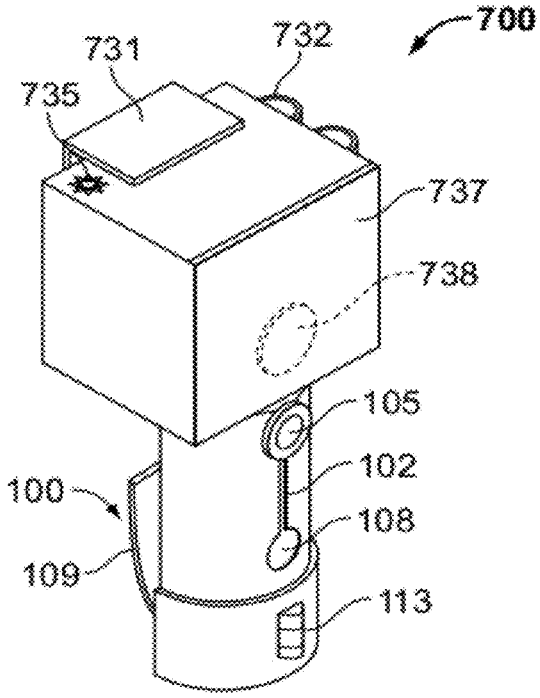
FIG. 17(*a*) shows a perspective view of the multi-function golf tool, the brush head (not shown) and the brush head cover when they are all coupled together, in accordance with one embodiment of the invention.
Figure 17B:
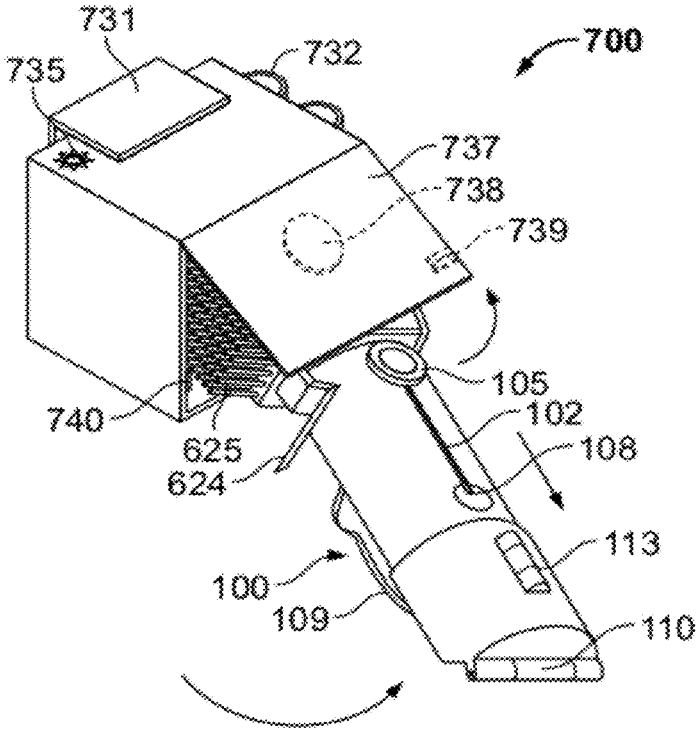

An exemplary brush unit 600 may be inserted into a brush cover 700 wherein the door magnet 738 and the brush head magnet 630 (not shown) may magnetically attract and secure the brush head 600 to door 737 as illustrated in FIG. 17(*a*). The multifunction golf tool 100 and the brush head 600 may removed from the brush head cover 700 as illustrated in the exemplary embodiment of FIG. 17(*b*). The door 737 may be pulled up while the multi-function golf tool 100 is held down. This causes a separation between the door magnet 738 and the brush head magnet 630 (not shown) which allows a golfer to separate the brush cover 700 from the brush head 600.

While various embodiments of the invention have been illustrated and described, those of ordinary skill in the art will appreciate that the above descriptions of the embodiments are exemplary only and that the invention may be practiced with modifications or variations of the devices and techniques disclosed above. For example, although various exemplary embodiments of a multi-function golf tool have been described herein with features that perform specific functions (i.e., divot fork, stroke counter, etc.), it is envisioned that a multi-function golf tool may include or exclude any number of the features and functions and be within the scope of the invention. Those of ordinary skill in the art will know, or be able to ascertain using no more than routine experimentation, many equivalents to the specific embodiments of the invention described herein. Such modifications, variations and equivalents are contemplated to be within the spirit and scope of the present invention.

What is claimed is:

1. A multi-function golf tool comprising:

a main housing;

a divot fork;

a longitudinal slot cut into the main housing;

a knob coupled to the divot fork, wherein the knob is guided by the longitudinal slot and is configured to push and pull the divot fork to extract it out of and retract it into the main housing through an opening at one end of the main housing; and a ball liner shaped to accommodate a golf ball and comprising a first end hingably attached to the main housing, wherein the ball liner comprises a longitudinal cut configured to allow the golf ball to be marked with a marking instrument, wherein the ball liner consists of a concave portion that cannot completely encircle the golf ball, wherein the concave portion includes the first end and a second end, and wherein the ball liner can be rotated about the housing so that the second end is positioned proximal to the main housing.

2. The multi-function golf tool of claim 1 wherein the knob is magnetic and is configured to magnetically attract a ball marker.

3. The multi-function golf tool of claim 1 wherein the ball liner further comprises a belt groove.

4. The multi-function golf tool of claim 1 further comprising a cleaning pad removably coupled to the main housing.

5. The multi-function golf tool of claim 1 further comprising a nylon brush coupled to the main housing.

6. The multi-function golf tool of claim 1 wherein the opening of the main housing further comprises a divot fork filter configured to prevent debris from entering the main housing from the divot fork.

7. The multi-function golf tool of claim 1 further comprising a level.

8. The multi-function golf tool of claim 1 further comprising a stroke counter.

9. The multi-function golf tool of claim 1 wherein both ends of the longitudinal slot are configured to latch the knob in a first and a second position, wherein in the first position the divot fork coupled to the knob is extended from the main housing and in the second position the divot fork coupled to the knob is retracted within the main housing.

10. The multi-function golf tool of claim 1 further comprising a brush head comprising:

one or more brushes;

a ball maintenance kit configured to repair torn golf balls, wherein the ball maintenance kit comprises a rough abrasive surface;

an opening in the brush head configured to accept insertion of the divot fork; and one or more sets of latches configured to be removably secured to the divot fork.

11. The multi-function golf tool of claim 10 further comprising a brush cover configured to removably attach to the brush head, the brush cover comprising:

a hanging hook configurable to hang on a belt, other article of clothing, or a golf bag;

an opening in the brush cover configured to accommodate the brush head; and a brush cover door configured to partially close the opening in the brush cover while still accommodating the brush head inside the brush cover.

12. A golf accessory for cleaning golf balls and clubs comprising:

a brush head comprising one or more brushes;

a ball maintenance kit configured to repair torn golf balls, wherein the ball maintenance kit comprises a rough abrasive surface;

an opening in the brush head configured to accept insertion of a divot fork; and a ball liner shaped to accommodate a golf ball and comprising a first end hingably attached to a main housing, wherein the ball liner comprises a longitudinal cut configured to allow the golf ball to be marked with a marking instrument, wherein the ball liner consists of a concave portion that cannot completely encircle the golf ball, wherein the concave portion includes the first end and a second end, and wherein the ball liner can be rotated about the housing so that the second end is positioned proximal to the main housing.

13. The golf accessory of claim 12 wherein the opening further comprises latches configured to removably latch onto the divot fork.

14. The golf accessory of claim 12 wherein the one or more brushes comprise an abrasive brush and a nylon brush, wherein the abrasive brush comprises non-woven fibers.

15. The golf accessory of claim 12 wherein the ball maintenance kit is configured to be removably attached to the brush head.

16. The golf accessory of claim 12 further comprising a brush cover that comprises:

a hanging hook configured to hang on a belt or other article of clothing;

an opening in the brush cover configured to accommodate the brush head; and a brush cover door configured to partially close the opening in the brush cover while still accommodating the brush head inside the brush cover.

17. The golf accessory of claim 12 further comprising a stroke counter that is a push button counter or an electric counter.

* * * * *